US005636580A

United States Patent [19]

Kanis

[11] Patent Number: 5,636,580

[45] Date of Patent: Jun. 10, 1997

[54] PYROLYSIS SYSTEM AND A METHOD OF PYROLYZING

[76] Inventor: Douglas R. Kanis, 2549 NW. Marshall St., Portland, Oreg. 97210

[21] Appl. No.: 561,849

[22] Filed: Nov. 22, 1995

[51] Int. Cl.[6] ..... F23G 5/00

[52] U.S. Cl. ..... 110/257; 110/255; 422/232; 222/241; 222/272

[58] Field of Search ..... 110/110, 227, 110/229, 257, 258; 222/239, 241, 272, 273, 412, 413; 422/232; 198/657

[56] References Cited

U.S. PATENT DOCUMENTS

| | | | |
|---|---|---|---|
| 775,448 | 11/1904 | Hague | 202/118 |
| 1,237,094 | 8/1917 | Prioleau | 202/118 |
| 1,927,219 | 9/1933 | Reed et al. | 202/218 |
| 1,978,139 | 10/1934 | Mason | 202/218 |
| 2,265,857 | 12/1941 | Reynoldson | 126/59.5 |
| 3,362,887 | 1/1968 | Rodgers | 201/2.5 |
| 3,908,839 | 9/1975 | Menaut | 222/412 |
| 4,084,521 | 4/1978 | Herbold et al. | 110/242 |
| 4,210,491 | 7/1980 | Schulman | 201/2.5 |
| 4,225,392 | 9/1980 | Taylor | 202/93 |
| 4,235,676 | 11/1980 | Chambers | 202/118 |
| 4,261,795 | 4/1981 | Reilly | 202/118 |
| 4,306,506 | 12/1981 | Rotter | 110/229 |
| 4,308,103 | 12/1981 | Rotter | 202/117 |
| 4,309,195 | 1/1982 | Rotter | 48/76 |
| 4,402,791 | 9/1983 | Brewer | 202/97 |
| 4,412,889 | 11/1983 | Oeck | 202/117 |
| 4,501,644 | 2/1985 | Thomas | 202/99 |
| 4,686,008 | 8/1987 | Gibson | 202/118 |
| 4,705,603 | 11/1987 | McMullen et al. | 202/109 |
| 4,708,268 | 11/1987 | Wurtz | 222/413 |
| 4,740,270 | 4/1988 | Roy | 201/35 |
| 4,746,406 | 5/1988 | Timmann | 201/25 |
| 5,046,265 | 9/1991 | Kalb | 34/402 |
| 5,271,809 | 12/1993 | Holzhausen | 196/110 |
| 5,271,827 | 12/1993 | Woebcke | 208/132 |
| 5,279,712 | 1/1994 | Constantine | 201/37 |
| 5,296,005 | 3/1994 | Wolfe et al. | 44/551 |
| 5,411,714 | 5/1995 | Wu et al. | 110/229 |

FOREIGN PATENT DOCUMENTS

| | | | |
|---|---|---|---|
| 2806334 | 8/1978 | Germany | 198/657 |

*Primary Examiner*—Henry A. Bennett
*Assistant Examiner*—Pamela A. O'Connor
*Attorney, Agent, or Firm*—Kolisch, Hartwell, Dickinson, McCormack & Heuser

[57] ABSTRACT

A pyrolysis system is provided for use in the pyrolytic distillation of various feedstock materials, such system including an elongate reaction chamber with an upstream end, a downstream end, an infeed port near the upstream end and a discharge port near the downstream end. An auger is disposed in the reaction chamber to convey feedstock from the infeed port to the discharge port through the reaction chamber. In one embodiment, the auger includes a reverse section downstream from the discharge port to create an accumulation zone. An input airlock coupled to the reaction chamber near the upstream end delivers charges of feedstock through the input port into the reaction chamber and an output airlock coupled to the discharge port of the reaction chamber receives therefrom pyrolyzed material. Heat is supplied by a furnace disposed around the reaction chamber to supply heat thereto. The gas produced during the pyrolysis is extracted through a gas extraction vent disposed near the upstream end of the reaction chamber.

18 Claims, 3 Drawing Sheets

PYROLYSIS SYSTEM AND A METHOD OF PYROLYZING

This invention relates generally to pyrolysis, and more particularly, to a pyrolysis system for use in the pyrolytic distillation of scrap materials. Although the invented system has broad utility, it is most notably used in connection with the processing of scrap rubber tires to extract carbon black, producer gas, steel and heating oil, and is described in that context below.

BACKGROUND

With the ever decreasing supply of landfill space, disposal of worn-out vehicle tires is becoming an increasingly significant problem. Over 250 million such tires were scrapped in the U.S. in 1992. Although some spent tires are recycled to be used in pavement and others are burned as boiler fuel, more than 80% are simply dumped in landfills.

Dumping used tires in landfills is a significant waste of recyclable resources. It has been known for many years that tires may be recycled by pyrolysis to obtain valuable by-products. Pyrolysis, generally speaking, is the thermal distillation or decomposition of a substance. In the case of tires, this process is carried out in a slight vacuum at temperatures between 1000° F. and 2000° F.

By recycling the tires through pyrolysis, it is possible to recover substantial amounts of heating oil, producer gas, carbon black and scrap steel. In particular, it is expected that using the apparatus described herein it will be possible to recover approximately 900 lbs of heating oil, 750 lbs of carbon black, 250 lbs of producer gas and 100 lbs of scrap steel from each ton of tires. Since the average used tire weighs 17.4 lbs, the potential production of tire by-products is enormous.

Although many machines have been designed to recycle used tires through pyrolysis, none have been entirely successful. One problem with many previous machines involves the presence of particulate matter in the gas that is extracted from the tires. The particulate matter—primarily carbon dust—accumulates on fittings, vents and flame arresters, which can obstruct passages and create substantial danger of explosion.

Another drawback to known pyrolysis machines involves oil contamination in the carbon black which destroys the commercial value thereof. In order to produce high quality carbon black, virtually all oil must be removed. In most known pyrolysis machines, the oil vapor released from the pyrolyzed material is drawn, at least partially, through or past the carbon black product, thus contaminating it with oil residue.

Material handling also has presented substantial challenges in known pyrolysis machines. When shredded tires are processed, the residual steel strands and natural stickiness of the heated rubber combine to make transporting the material to be pyrolyzed a significant challenge. Thus, a persistent problem with known machines is "bailing-up" of the shredded tire pieces leading to jamming of the auger used to convey them. The shredded pieces may also agglomerate in the bridge openings or plug pipes.

Accordingly, it is an object of the present invention to provide a pyrolysis system to efficiently process used vehicle tires and other hydrocarbon-based material.

Another object of the invention is to provide such a system with low environmental emissions.

One more object of the present invention is to provide a pyrolysis system in which the gas and oil vapor generated is prefiltered to remove particulate matter.

Yet another object is to provide a system that is able to continuously process spent tires.

An additional object of the present invention is to provide a pyrolysis system that produces high-grade carbon black as a byproduct of the pyrolytic decomposition of hydrocarbon material.

SUMMARY OF THE INVENTION

The invented pyrolysis system is used to pyrolyze various feedstock materials and includes an elongate reaction chamber with an upstream end, a downstream end, an infeed port near the upstream end and a discharge port near the downstream end. An auger is disposed in the reaction chamber to convey feedstock from the infeed port to the discharge port through the reaction chamber. In one embodiment, the auger includes a reverse section downstream from the discharge port to create an accumulation zone. An input airlock chamber coupled to the reaction chamber near the upstream end delivers charges of feedstock through the infeed port into the reaction chamber and an output airlock chamber coupled to the discharge port of the reaction chamber receives therefrom pyrolyzed material. Heat is supplied by a furnace disposed around the reaction chamber to supply heat thereto. The gas produced during pyrolysis is extracted through a gas extraction vent disposed near the upstream end of the reaction chamber.

Many other features, advantages and additional objects of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION

Figure 1:
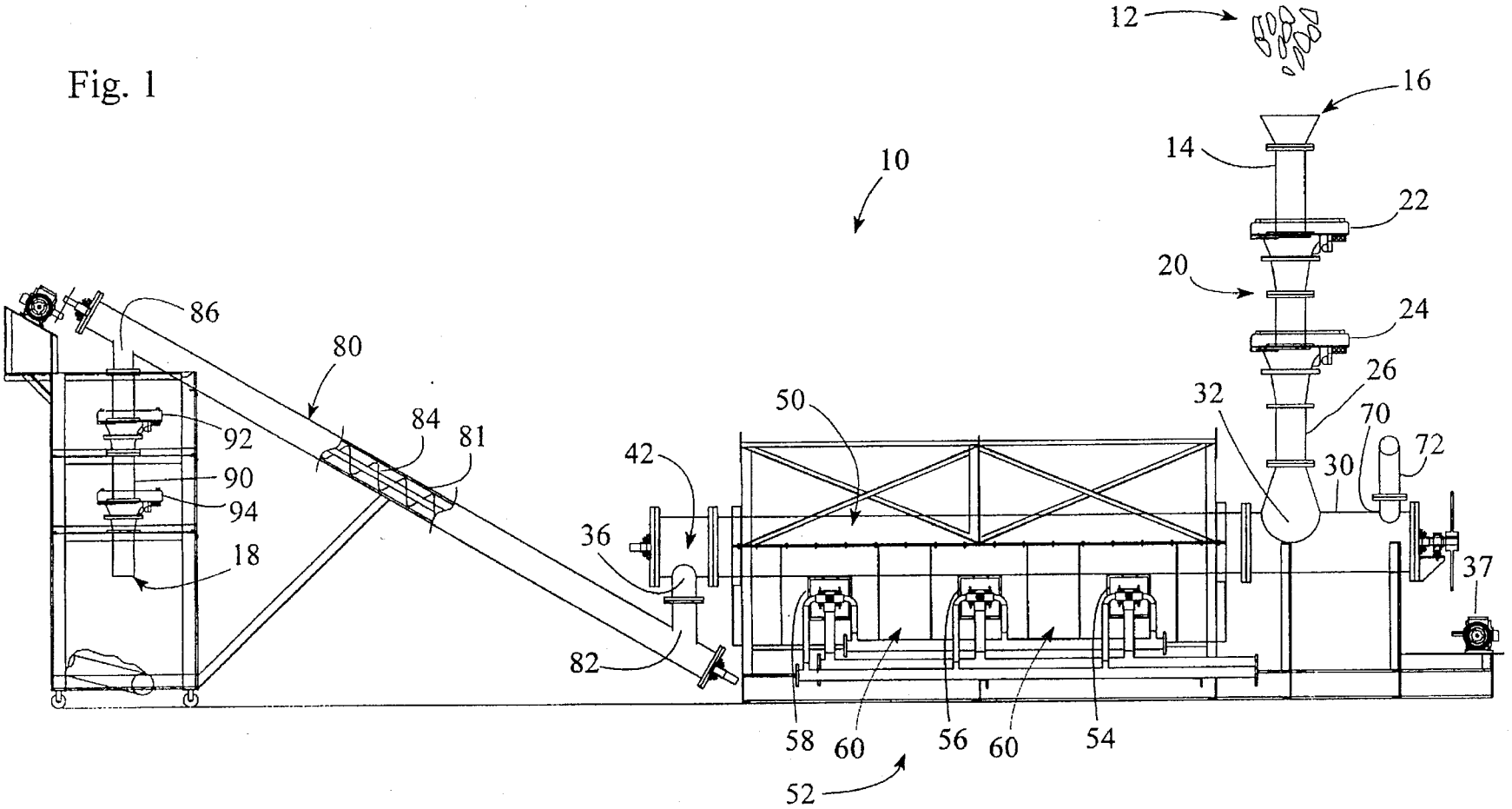
FIG. 1 is a diagrammatic elevational view of a pyrolysis system according to the present invention.

A pyrolysis system according to the present invention is shown generally at 10 in FIG. 1. In the preferred embodiment, system 10 processes organic material in the form of spent tires. Because different types of tires have different compositions, it is desirable to presort the tires into like groups. The sorted tires are debeaded and shredded into two-inch and smaller pieces prior to being delivered to the system. These shredded tire pieces are conveyed over a magnetic separator to remove any loose steel. The shredded tire pieces with loose steel removed constitute feedstock 12 for system 10.

Feedstock 12 is delivered to a feedchute 14 at an upstream end 16 of system 10. The feedstock generally proceeds from upstream end 16 to a downstream end 18 where it passes out of system 10. The first step in this journey is passage through the feedchute into an input airlock chamber 20.

Airlock chamber 20 includes an input airlock 22 and an output airlock 24. In the preferred embodiment, Mucon™

12-inch airlocks are used for airlocks 22, 24. Feedchute 14 is disposed just above input airlock 22 so that when the airlock opens, a charge of feedstock drops into airlock chamber 20. In the preferred embodiment, a volume of about 5 gallons of feedstock are cycled through the airlock chamber at a time. Once the feedstock is in place in chamber 20, the input airlock closes and the output airlock, which is disposed directly below the input airlock, opens to release the charge. Because the input airlock is closed prior to the opening of output airlock 24, no substantial amounts of air are allowed to follow the charge of feedstock. The normal cycle time for passing charges of feedstock through the airlock chamber is approximately 30 seconds.

Feedstock 12 passes out of airlock chamber 20 through a heat exchanger 26, the purpose of which will be described below, and into an elongate auger tube 30 via an infeed port 32 formed in the perimeter of the tube several feet from its upstream end. The infeed port is disposed directly below the airlock chamber and therefore the feedstock simply falls into the auger tube under the influence of gravity. The auger tube houses a furnace auger 34 which conveys the feedstock from the infeed port to a discharge port 36. Auger 34 is driven by a variable speed motor 37 which is connected to the auger via an appropriate drive mechanism (not shown) so that the speed of the material traveling through the auger tube can be controlled. Transit time can be varied from 4–5 minutes to about 30 minutes. In the preferred embodiment, auger tube 30 is formed of stainless steel and has a 24-inch outside diameter, ¾-inch thick walls and a 22½-inch inside diameter.

Auger 34 has an outside diameter of 2¾-inches and includes a right-hand auger flight 38 which begins at the upstream end of the auger tube and extends to the output port. A reverse section in the form of a left-hand auger flight 40 begins at the downstream end of the auger tube and extends back toward the output port for approximately 6-inches. See FIG. 3. Flights 38 and 40, together, act to create an accumulation zone 42 at their convergence. Specifically, as auger 34 rotates, flight 38 conveys material to the left in FIG. 3 toward the accumulation zone. Without flight 40, material would tend to collect at the downstream end of the auger tube, possibly interrupting the normal flow. Flight 40 urges any such material back to the right in FIG. 3 toward the accumulation zone, thus preventing material buildup at the downstream end of the auger. Discharge port 36 is disposed under accumulation zone 42 so that material transported by the furnace auger drops down out of the auger tube through the port.

Figure 2:
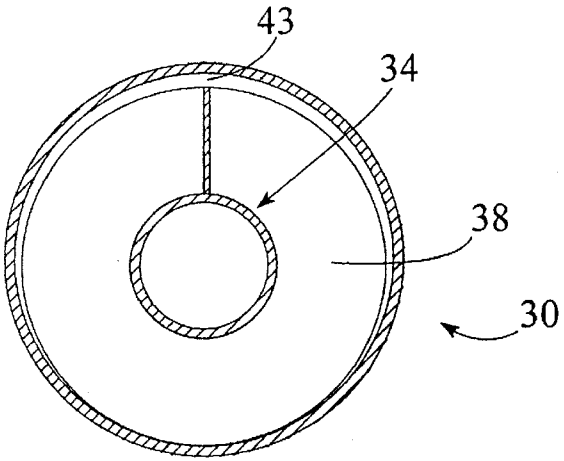
FIG. 2 is a cross-sectional view of a reaction chamber from the pyrolysis system shown in FIG. 1.

As shown in FIG. 2, the axis of auger 34 is offset slightly downwardly from the axis of tube 30 so that a ¾-inch gap 43 is created between the top of the tube and the outer edge of the auger flights. At the bottom, the auger flights ride on the inside surface of the tube. By providing the gap at the top, any pieces caught between the auger flight and the tube is freed as it is turned toward the top, which helps the auger to clear as it rotates and thereby prevents clogging or jamming. By having close contact at the bottom, the auger is still able to convey small particles forward in the tube.

Figure 3:
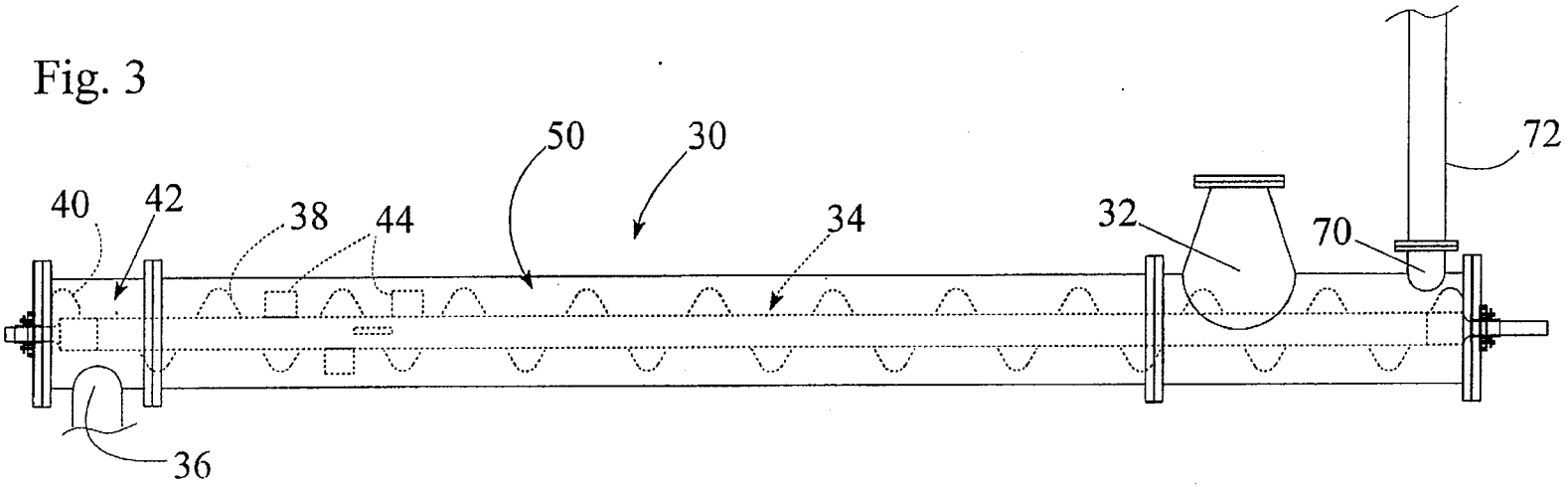
FIG. 3 is a diagrammatic elevational view of the reaction chamber from FIG. 2, a furnace auger with agitation paddles being shown to illustrate the present invention.

A plurality of agitation paddles 44 are provided on the downstream portion of auger 34. See FIG. 3. Agitation paddles 44 are flat metal plates approximately 6-inches square and extend radially from the shaft of auger 34 parallel to the axis thereof. The paddles are placed between the auger flights at intervals of 85-degrees around the auger and extend outwardly to the outer edge of the auger, rubbing on the inside of the auger tube at the bottom. The paddles help to stir and mix the fine pyrolysis products found in the later stages of decomposition. It should be noted that only a few of the many paddles are illustrated in FIG. 3 in order to maintain clarity.

Figure 4:
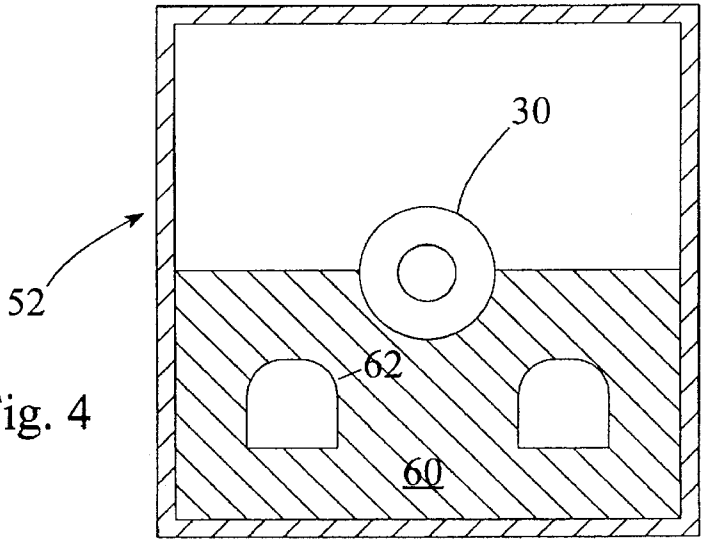
FIG. 4 is a cross-sectional view of a furnace from the pyrolysis system of FIG. 1 showing a tube support.

Most of the length of auger tube 30 between the infeed and output ports forms a reaction chamber 50 where the actual pyrolysis takes place. Chamber 50 is enclosed in and heated by a furnace 52. Two auger tube supports, positioned generally at indicators 60 in FIG. 1 and shown in cross section in FIG. 4, are disposed in the furnace to support the portion of the auger tube in the furnace. Supports 60 each include 12-inch square air passages 62 to promote free heat exchange.

Furnace 52 should maintain the temperature within the reaction chamber at a relatively constant value of approximately 1850° F. In order to accomplish this, the furnace includes first, second and third burners 54, 56 and 58, respectively. Because the feedstock enters the reaction chamber cold, the first burner, which is disposed near the upstream end, has the largest heat output. As the feedstock is conveyed through the reaction chamber and the pyrolysis proceeds, less heat is required to maintain the desired temperature. Consequently, the output of the third burner is less than that of the second, which is less than that of the first.

When the feedstock enters the reaction chamber and pyrolysis begins, considerable mounts of volatile gas are liberated as the tire pieces are reduced to carbon black, ash and scrap steel pieces. The gas created in the reaction chamber includes various types of vaporized oil as well as producer gas. The gas and vapor are drawn out of the reaction chamber through a gas extraction vent 70 disposed in the upper surface of the auger tube upstream end from the infeed port. They then proceed through vent 70 up into a vertically oriented settling pipe 72, which is about 8-inches in diameter and 6-feet in length. The diameter, length and orientation of the settling pipe combine to reduce the velocity of the gas and allow any residual particulate matter in the gas stream an opportunity to settle out, as illustrated schematically in FIG. 5.

The gas produced in the reaction chamber is drawn out of the settling pipe under a slight vacuum and into a large condenser 74, where the various constituent components are separated out. In particular, the condenser cools the gas stream and thereby extracts the oil fraction, which has a higher condensation temperature. The extracted oil is stored in tanks and is suitable for use as heating oil. The gas which passes through the condenser is producer gas, and approximately half of this gas is redirected back to fire the burners in the furnace. The excess producer gas is flared, but could be used for other purposes as well. It should be noted that the downstream end of the pyrolysis system is sealed, as will be described below, to prevent air from being draw into the reaction chamber from the discharge port. Thus, only gas produced by pyrolysis is present in the reaction chamber.

Figure 5:
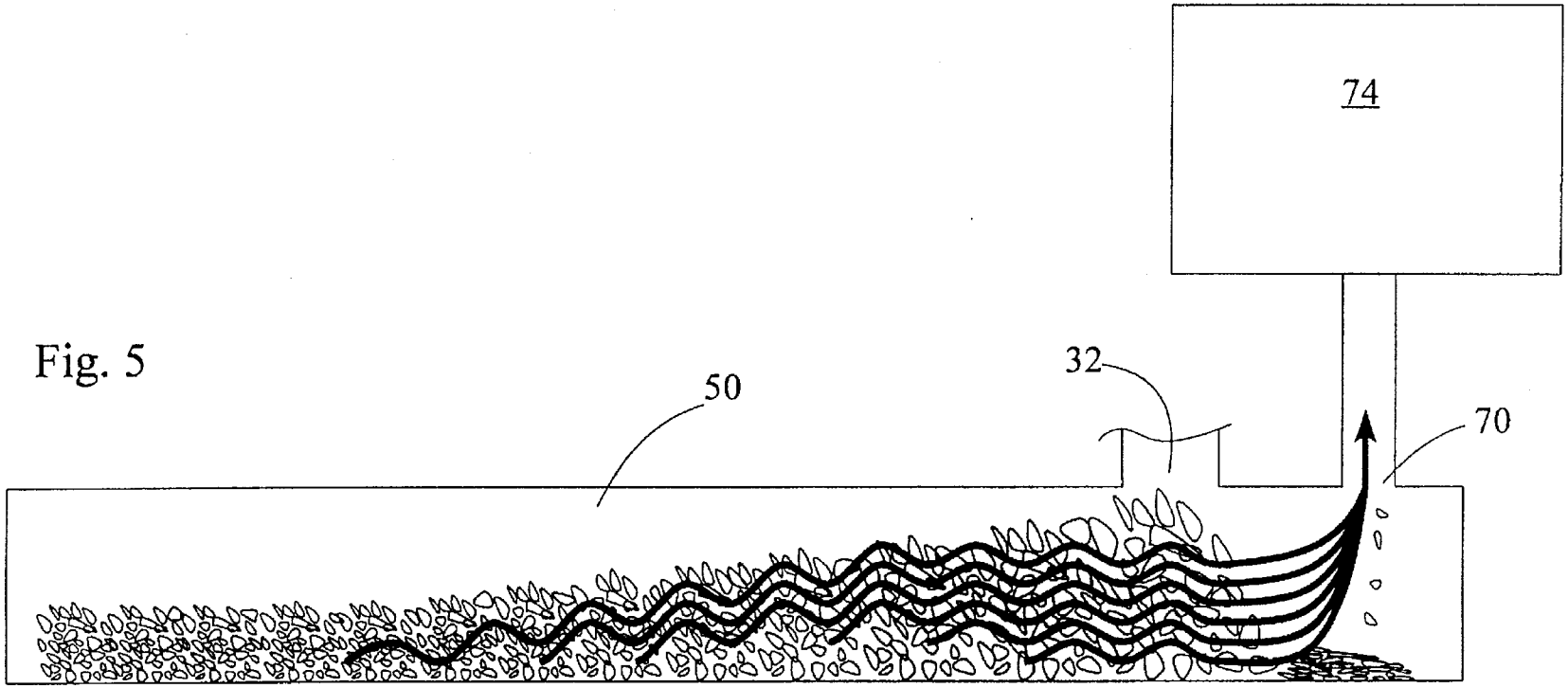
FIG. 5 illustrates the flow of gases in the pyrolysis system of the present invention.

The flow of gas produced during pyrolysis is an important feature of the present invention and is illustrated diagrammatically in FIG. 5. Because the extraction vent is disposed at the upstream end of the reaction chamber, any gas produced in the chamber is drawn upstream through the chamber against the flow of the feedstock. This pre-filters the gas, removing substantially all of the particulate matter from the gas, thus preventing the buildup on fittings and other structures that would otherwise occur. As an additional benefit, the incoming feedstock is pre-heated somewhat prior to entering the reaction chamber. Although this pre-heating is beneficial overall, a heat exchanger 26, such as a water jacket, is used on output airlock 24 to prevent excess heating of the airlock seals and gaskets.

The gas flow in the present system helps to create a high-grade of carbon black. In known pyrolysis machines, the gas produced during pyrolysis is extracted from the downstream end of the reaction chamber. This causes the liberated gas, which includes vaporized oil, to be drawn through the carbon black found in the later stages of pyrolization, thus contaminating it with oil. In the present invention, the oil vapors, which are produced at the highest rate early in the pyrolization process, are drawn back upstream through the tire pieces away from the carbon black. The carbon black is therefore only exposed to the small residual amounts of oil produced in the later stages of pyrolization. Thus, as the carbon black proceeds further downstream in the reaction chamber, the amount of oil vapor in the environment becomes progressively reduced of oil vapor. Extraction of residual oil contamination on the carbon black particles is facilitated by the agitation paddles which stir the carbon black powder so that all of the particles are exposed to the surface and any remaining oil is thus vaporized and removed.

The carbon black exiting the reaction chamber through discharge port 36 is still at approximately 1800° F. and therefore would oxidize if exposed to the atmosphere. In order to avoid this, the carbon black is passed through a carbon auger tube 80 with an water jacket heat exchanger. Auger tube 80 includes an input port 82 disposed below the discharge port 36 so that material leaving the reaction chamber drops into the carbon auger tube. A motor-driven carbon conveyor or auger 84 is disposed in tube 80 to convey the carbon from the input port to an output port 86.

As the carbon black is transported through tube 80, it gradually cools until it reaches the output port where it drops into an output airlock chamber 90. Output chamber 90 is very similar to input airlock chamber 20, and includes an input airlock 92 and output airlock 94. Because of the reduction in volume of material as a result of the pyrolysis process, chamber 90 is smaller than the input airlock chamber (8-inches verses 12-inches). In general, however, the output chamber cycles in the same fashion as the input chamber to pass material without letting air into the system. After the carbon black exits the airlock, it is passed through a magnetic separator (not shown) to remove the remaining strands of steel.

Although the present system has been designed to be especially effective when used to pyrolyze scrap tires, it also can be used to pyrolyze other hydrocarbon-based materials such as garbage, plastic, sewage, coal and some types of hazardous wastes. It will be understood that other types of materials may require temperature and processing time changes for optimization.

It will now be clear that an improvement in this art has been provided which accomplishes the objectives heretofore set forth. While the invention has been disclosed in its preferred form, it is to be understood that the specific embodiment thereof, as disclosed and illustrated herein, is not to be considered in a limited sense, as there are other forms or modifications which should also be construed to come within the scope of the appended claims.

I claim:

1. A pyrolysis system comprising:

an elongate reaction chamber with an upstream end, a downstream end, an infeed port near the upstream end and a discharge port near the downstream end;

an auger disposed in the reaction chamber to convey feedstock from the infeed port to the discharge port through the reaction chamber;

an input airlock coupled to the reaction chamber near the upstream end to deliver charges of organic material through the infeed port into the reaction chamber;

an output airlock coupled to the discharge port of the reaction chamber to receive therefrom pyrolyzed material;

a furnace disposed around the reaction chamber to supply heat thereto; and a gas extraction vent disposed near the upstream end of the reaction chamber, the gas extraction vent being configured to draw the bulk of gas produced in the reaction chamber during pyrolysis upstream through the reaction chamber against the flow of the feedstock.

2. The system of claim 1, wherein the reaction chamber and auger are disposed in an auger tube and the axis of the auger is offset from the axis of the tube.

3. The system of claim 1, wherein the auger includes a reverse section downstream from the discharge port to urge feedstock upstream, thereby creating an accumulation zone over the discharge port.

4. The system of claim 1, further including an oil condenser connected to the gas extraction vent through a generally vertical elongate settling pipe.

5. The system of claim 1, wherein the auger includes a shaft, a helical auger flight on the shaft and a plurality of agitator paddles with diameter less than or substantially equal to the diameter of the flight, the paddles being fixed to the shaft between rams of the flight.

6. The system of claim 1, further including a carbon conveyor disposed between the discharge port and the output airlock to cool output from the discharge port.

7. The system of claim 1, further including a variable speed motor to drive the auger at a selectable speed.

8. A pyrolysis system comprising:

an elongate reaction chamber with an upstream end, a closed downstream end, an infeed port near the upstream end and a discharge port near the downstream end;

an auger disposed in the reaction chamber to convey feedstock from the infeed port to the discharge port through the reaction chamber, the auger including a reverse section disposed in the closed downstream end of the reaction chamber downstream from the discharge port to create an accumulation zone by urging any feedstock that is carried downstream past the discharge port back toward the discharge port;

an input airlock coupled to the reaction chamber near the upstream end to deliver charges of organic material through the infeed port into the reaction chamber;

an output airlock coupled to the discharge port of the reaction chamber to receive therefrom pyrolyzed organic material; and a furnace disposed around the reaction chamber to supply heat thereto.

9. The system of claim 8, wherein the auger includes a shaft, a helical auger flight with multiple turns on the shaft and a plurality of agitator paddles with diameter less than or substantially equal to the diameter of the flight, the paddles being fixed to the shaft between the turns of the flight.

10. The system of claim 8, wherein the auger has an outside diameter and an elongate axis and is disposed in an elongate auger tube with an elongate axis and an inside diameter larger than the outside diameter of the auger, where the elongate axis of the auger is offset from the elongate axis of the auger tube.

11. The system of claim 10, wherein the axis of the auger is offset downwardly from the axis of the auger tube.

12. A method of pyrolyzing hydrocarbon-based feedstock to produce gas and carbon black the method comprising:

providing a pyrolysis system with a reaction chamber having an upstream end, a downstream end, an infeed port near the upstream end and a discharge port near the downstream end, the reaction chamber further having a heated region disposed between the input and output ports, the heated region being enclosed other than at the ends;

supplying feedstock to the reaction chamber through the infeed port;

heating the feedstock in the heated region of the reaction chamber;

transporting the feedstock toward the discharge port;

removing the gas produced during pyrolysis from the reaction chamber from a location upstream from the heated region to draw the gas through the feedstock in a direction opposite to the flow thereof and thereby filter the gas; and removing the gas from the reaction chamber near the upstream end.

13. The method of claim 12, further including recycling at least a portion of the gas removed from the reaction chamber back to a burner to heat the reaction chamber.

14. The method of claim 12, wherein supplying the feedstock includes passing the feedstock through an airlock to prevent air entry through the input port.

15. The method of claim 12, further including selecting used tires as the feedstock and shredding the tires prior to supplying the feedstock to the reaction chamber.

16. The method of claim 15, further including of removing carbon black from the reaction chamber and cooling the removed carbon black prior to exposing it to the atmosphere.

17. The method of claim 16, further including of providing a water cooled auger to transport and cool the carbon black after removal from the reaction chamber.

18. A syste for use in pyrolitic conversion of a material from a first state wherein the material is defined principally by large particles to a second state wherein the material is defined principally by smaller particles, the conversion resulting in creation of a gas byproduct, the system comprising:

an elongate pyrolitic reaction chamber through which the material passes, the material being converted from the first state near a first end of said reaction chamber to the second state near a second end of said reaction chamber;

a furnace disposed around the reaction chamber to supply heat thereto; and a vacuum gas extraction vent disposed near the first end of the reaction chamber where the material is in a first state with the material defined principally by larger particles, providing for filtration of the bulk of the gas through the material within said pyrolitic reaction chamber.

* * * * *